United States Patent [19]

Ransom

[11] 4,342,369

[45] Aug. 3, 1982

[54] CONTROL GRIP FOR ANSATE SELF-PROPELLED APPLIANCE

[75] Inventor: Frederick J. Ransom, Dunwoody, Ga.

[73] Assignee: The Singer Company, Stamford, Conn.

[21] Appl. No.: 199,882

[22] Filed: Oct. 23, 1980

[51] Int. Cl.[3] ..... A47L 9/32; B62D 51/04

[52] U.S. Cl. ..... 180/19 H; 15/340; 74/503

[58] Field of Search ..... 180/19 H, 19 S, 19 R; 15/340, 410; 74/503

[56] References Cited

U.S. PATENT DOCUMENTS 2,138,239 11/1938 Irgens ..... 180/19 H 3,618,687 11/1979 Ripple et al. ..... 15/340 X

*Primary Examiner*—John A. Pekar

*Attorney, Agent, or Firm*—Robert E. Smith; Edward L. Bell

[57] ABSTRACT

An ansate self-propelled appliance, such as a self-propelled upright floor covering vacuum cleaner is provided with a slidable hand or control grip comprising a pair of clam-shell hand grip halves held on the distal end portion of the cleaner handle by a pair of transverse screws or other fasteners. A rotatable ring is also mounted with the hand grip halves at the forward end portions thereof which has at least one generally arcuate detent spring constructed and arranged to cooperate with and be selectively engagable within a pair of detent apertures or recesses angularly spaced apart around the handle tube. One of said detent apertures or recesses is longitudinally elongated so as to define a slot and enable said detent to slide longitudinally therein for self-propelled operation of the cleaner in response to sliding movement of the hand grip. The other of said detent apertures or recesses is substantially coextensive with the width of the detent spring so that when the detent is engaged therein, the hand grip is locked in a neutral position against longitudinal movement for manual propulsion of the cleaner. Preferably, two detents and two pairs of recesses, spaced diametrically opposite, are provided.

2 Claims, 5 Drawing Figures

Fig. 1.
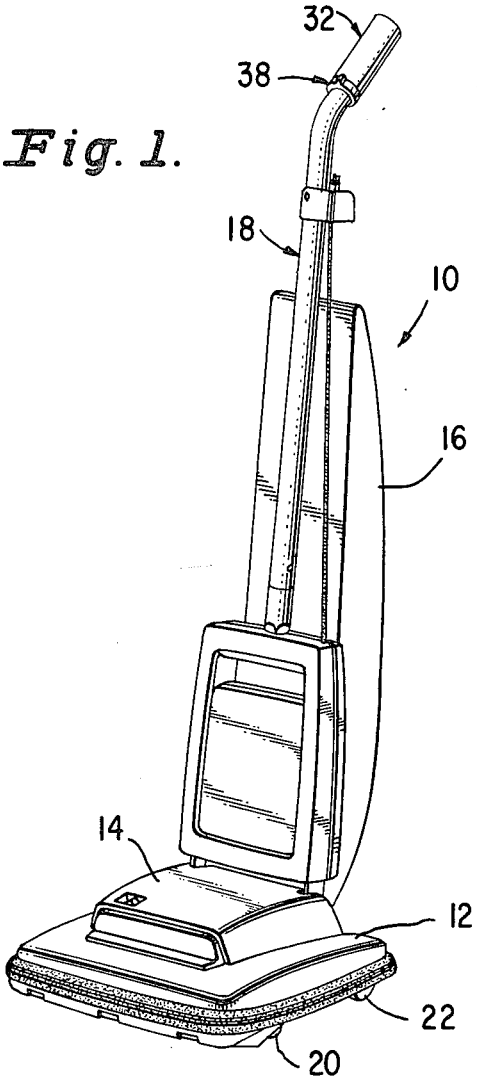
Fig. 5.
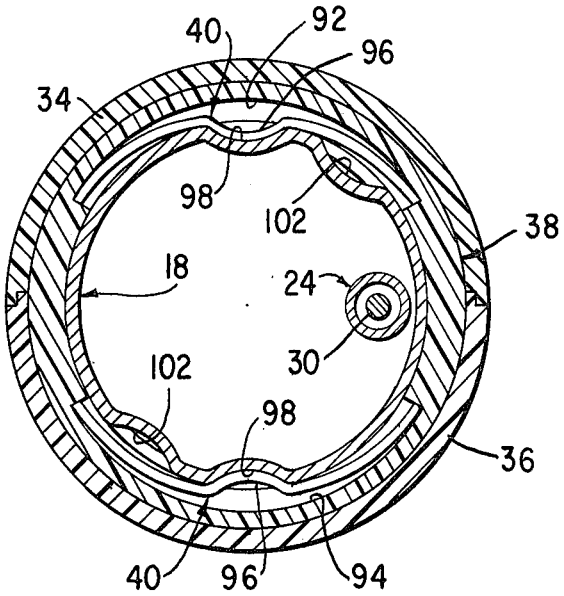
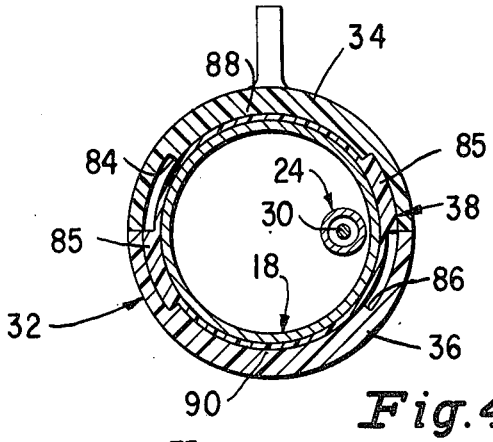
Fig. 4.
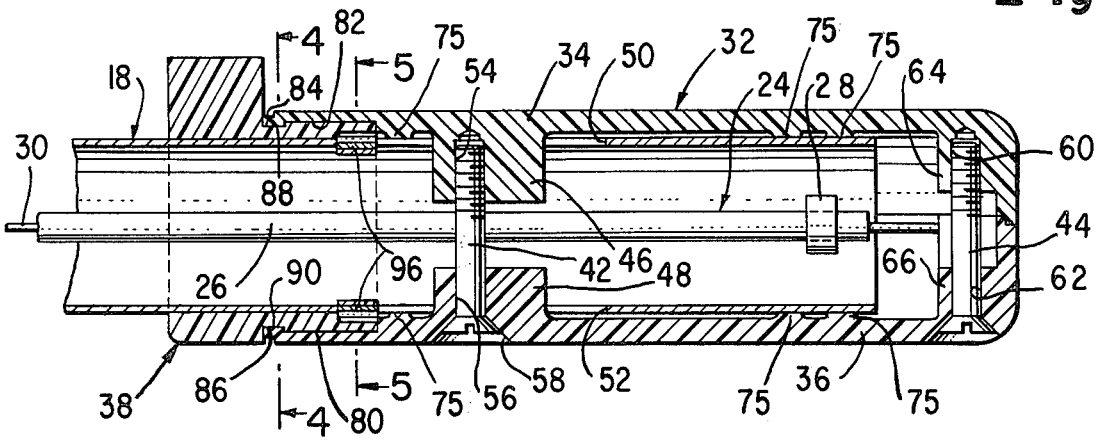
Fig. 2.

CONTROL GRIP FOR ANSATE SELF-PROPELLED APPLIANCE

FIELD OF THE INVENTION

This invention relates to ansate self-propelled appliances and, more particularly, to control or hand grips therefor and has found especial utility in a drive control for self-propelled upright vacuum cleaners.

BACKGROUND OF THE INVENTION

Self-propelled appliances, such as lawn mowers, upright vacuum floor cleaners, and the like, have been heretofore provided including a drive engine or motor for operating the appliance mounted on a wheeled chassis having a handle extending generally upwardly thereof. Such drive engine or motor is used to power the working components of the appliance such as the cutting blade or blades of a lawn mower, or the like, or the suction fan and/or brush roll of a vacuum cleaner. It has also been suggested to use the same engine or motor to propel such appliance with transmission means being also mounted on the chassis for utilizing the drive engine or motor to propel the appliance in a forward and/or reverse direction under the control of the operator. It has also been heretofore suggested to provide such appliances with a control or hand grip slidable on the handle and connected with such transmission means so that when the control or hand grip is pushed forwardly, the transmission is engaged automatically to propel the appliance forwardly and when the control or hand grip is pulled rearwardly the transmission is similarly automatically engaged in a reverse drive configuration to propel the appliance rearwardly. A suitable transmission is shown, for example, in U.S. patent application Ser. No. 228,021 filed Jan. 23, 1981 by Scott Bair, assigned to the assignee of the instant application, and incorporated by reference herein.

OBJECT OF THE INVENTION

Bearing in mind the foregoing, the primary object of the present invention is to provide a new and improved control or hand grip for a self-propelled ansate appliance, which is economical to manufacture and durable and effective in use.

Another primary object of the present invention, in addition to the foregoing object, is the provision of such a control or hand grip which is slidable on the appliance handle and adapted for connection with a reversible transmission so that forward sliding movement thereof on the handle is effective to engage the transmission for forward drive of the appliance and rearward sliding movement of the hand grip is effective for engaging the transmission for reverse drive of the appliance.

Still another primary object of the present invention, in addition to each of the foregoing objects, is the provision such hand grip provided with a rotatable locking ring for selectively locking the hand grip in a neutral position and against such sliding motion for manual movement of the appliance.

Yet another primary object of the present invention, in addition to each of the foregoing objects, is the provision of such hand grip and locking ring which is adapted for rapid and simple assembly.

Yet still another primary object of the present invention, in addition to each of the foregoing objects, is the provision of such a control hand grip and locking ring incorporating a novel detent arrangement for controlling the rotational position of the locking ring.

A yet further primary object of the present invention, in addition to each of the foregoing objects, is the provision of such control hand grip having novel and improved guiding means for enabling sliding movement thereof while precluding rotation thereof on the appliance handle.

Another and still further primary object of the present invention, in addition to each of the foregoing objects, is the provision of novel and improved upright vacuum cleaners for floor coverings and the like incorporating the control grip and locking ring of the present invention.

The invention resides in the combination, construction, arrangement and disposition of the various component parts and elements incorporated in new and improved control grips for handles for self-propelled appliances and appliances incorporating the same in accordance with the principals of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principals thereof. Other embodiments or modifications may be suggested to those having the benefit of the teachings herein, and such other embodiments or modifications are intended to be reserved, especially as they fall within scope and spirit of the subjoined claims.

SUMMARY OF THE INVENTION

In accordance with the present invention, an ansate self-propelled appliance, such as a self-propelled upright floor covering vacuum cleaner is provided with a slidable hand or control grip comprising a pair of clamshell hand grip halves held on the distal end portion of the cleaner handle by a pair of transverse screws or other fasteners. A rotatable ring is also mounted with the hand grip halves at the forward end portions thereof which has at least one generally arcuate detent spring constructed and arranged to cooperate with and be selectively engageable within a pair of detent apertures or recesses angularly spaced apart around the handle tube. One of said detent apertures or recesses is longitudinally elongated so as to define a slot and enable said detent to slide longitudinally therein for self-propelled operation of the cleaner in response to sliding movement of the hand grip. The other of said detent apertures or recesses is substantially coextensive with the width of the detent spring so that when the detent is engaged therein, the hand grip is locked in a neutral position against longitudinal movement for manual propulsion of the cleaner. Preferably, two detents and two pairs of recesses, spaced diametrically opposite, are provided.

BRIEF DESCRIPTION OF THE DRAWING

Although the specification concludes with claims particularly pointing out and distinctly claiming the subject matter regarded as forming the present invention, it is believed the invention will be better understood and objects and important features other than those specifically enumerated above will become apparent from the hereinafter set forth detailed description of the invention taken in conjunction with the annexed drawing wherein like reference characters are used for the parts throughout the several views and, in which:

FIG. 1 is a perspective illustration of an ansate upright self-propelled vacuum cleaner for floor covering, or the like, embodying the present invention;

FIG. 2 is an enlarged cross sectional illustration of the hand grip portion of the handle thereof, taken generally along a vertical plane;

FIG. 4 is an enlarged cross sectional illustration taken along line 4—4 of FIG. 2; and FIG. 5 is a further enlarged cross sectional illustration taken along line 5—5 of FIG. 2.

DETAILED DESCRIPTION OF THE INVENTION

Figure 3:
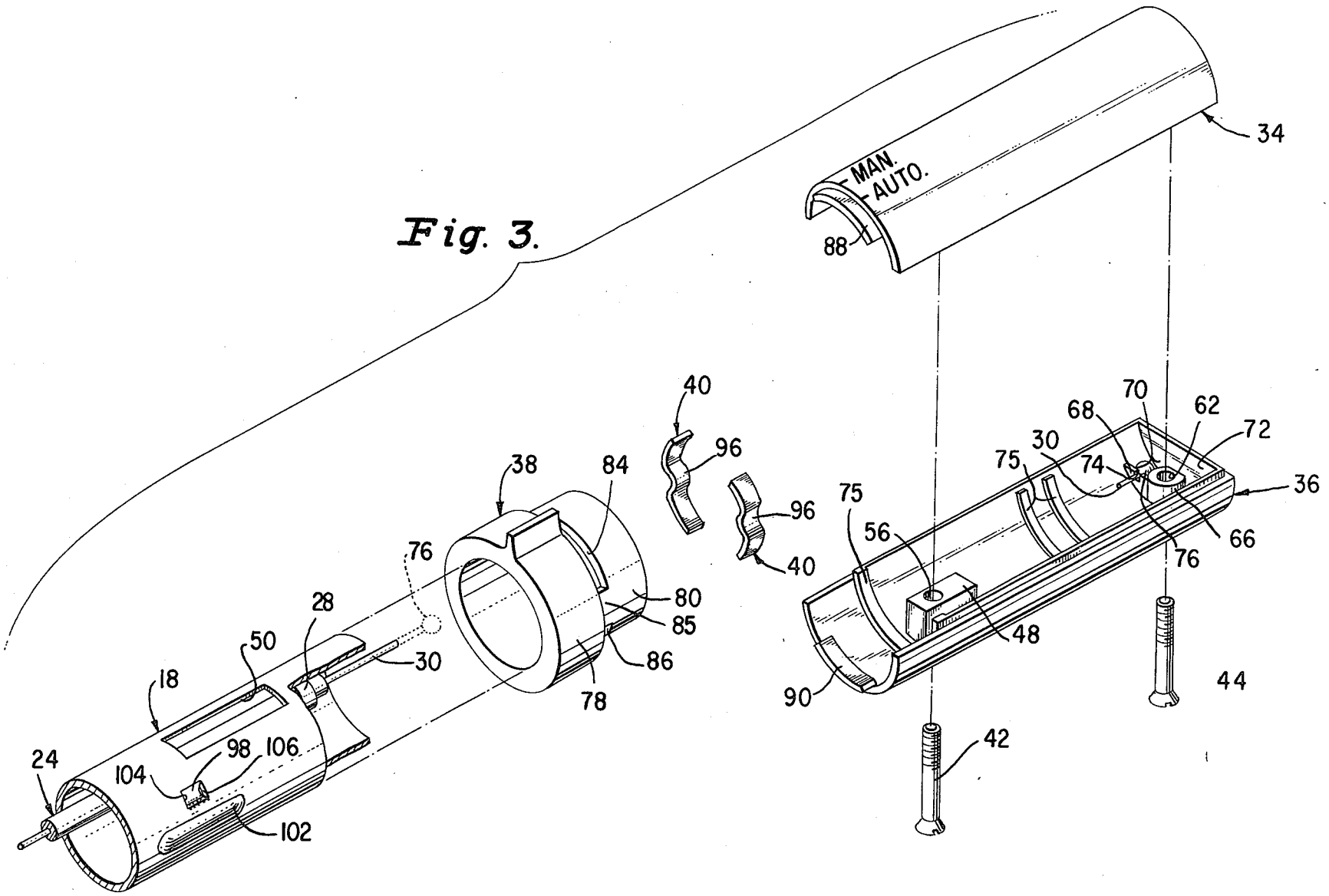
FIG. 3 is an exploded perspective illustration of the hand grip portion shown in FIG. 2.

With reference now to the drawing, there is shown and illustrated an ansate upright vacuum cleaner for floor coverings, or the like, designated generally by the reference character 10 comprising a chassis 12 carrying a top cover 14 and including the usual motor, agitator and suction fans for lifting dirt and debris from floor coverings, or the like, and blowing it into a collection bag 16 suspended from the upper end portion of a handle tube 18 pivotally mounted to the chassis 12. The lower end portion of the bag 16 is attachable to the chassis 12 sorrounding a discharge tube, not shown. The upper end portion of the handle tube 18 is provided with a slidable hand or control grip 32 and associated locking ring 38, as will be described in more detail hereinafter. Also mounted to the chassis 12 are a pair of front wheels 20 which may be of variable height so as to adjust the nozzle height of the chassis 12 and a pair of rear wheels 22 driven from the motor through transmission means, not shown, which may, for example, be of the type as disclosed in copending application Ser. No. 228,021 filed Jan. 23, 1981 by Scott Bair, assigned to the assignee of the instant application and incorporated herein by reference, as fully and completely as if reproduced hereat.

The transmission may be of the reversible type, controlled by a Bowden cable 24 extending longitudinally of the handle tube 18. The Bowden cable 24 comprises a casing 26 mounted with the handle tube 18 adjacent the upper end portion thereof, as by being mounted within a clip 28, formed in the handle tube 18, and an inner core 30 reciprocable within the casing 26 and having its upper end portion mounted for movement with the band grip 32. The Bowden cable 24 is operatively associated with the transmission so that when the core 30 of the Bowden cable is advanced toward the chassis 12, the transmission drives the wheels 22 in a forward direction and when the core 30 of the Bowden cable 24 is pulled away from the chassis 12, the transmission drives the wheels 22 rearwardly. In a neutral position, the transmission is in neutral and does not drive the wheels 22 in either direction. Locking means, not shown, may also be provided as described in the aforesaid Bair application to automatically lock the transmission in neutral when the handle 18 is raised to its upright position.

The control and hand grip 32 comprises an upper clam-shell half 34, and a lower clam-shell half 36. The locking ring 38 is provided with a pair of generally arcuate spring detents 40. A pair of screws 42 and 44 hold the control or hand grip clam-shell halves 34 and 36 together and mounted with the handle tube 18 and locking rings 38.

In order to cooperate with the control or hand grip 32 and locking ring 38, the handle tube 18 is pierced and perforated in multiple locations. Each of the control or hand grip clam-shell halves 34 and 36, respectively, are provided with generally rectangular inwardly extending bosses 46 and 48, respectively, and the handle tube 18 is provided with a pair of diametrically opposed mating generally rectangular perforations or fenestrations 50 and 52, respectively. The fenestrations 50 and 52 are of a width substantially coextensive with the width of the bosses 46 and 48 so that, when the bosses 46 and 48 are inserted into the fenestrations 50 and 52 angular or rotational movement of the hand control clam-shell halves 34 and 36 is precluded. The length of the fenestrations 50 and 52, however, is longer than the length of the bosses 46 and 48 so that the hand grip control clam-shell halves 34 and 36 may slide longitudinally therealong. The bosses 46 and 48 are also provided with apertures 54 and 56, respectively, the aperture 56 extending through the boss 48 and being provided at its outer end with a countersink 58 so that the screw 42 may be inserted through the bore 56 with the threads thereof engaged within the bore 54 to hold the hand grip control clam-shell halves 34 and 36 together and mounted with the handle tube 18. Similar apertures 60 and 62 in bosses 64 and 66, respectively, extending inwardly adjacent the outermost end portion of the hand grip clam-shell halves 34 and 36, respectively, for receiving the screw 44. Adjacent the boss 66, the hand grip control clam-shell half 36 is also provided with a generally laterally extending rib 68 defining a pocket 70 internally of the end wall 72 and the rib 68 is provided with a slot 74 into which the core 30 of the Bowden cable 24 extends, the end portion of the core 30 being provided with an enlarged protuberance 76 which may, for example, be generally ball shaped, as shown, and which rests within the pocket 70 so that, upon sliding movement of the hand grip control 32, as guided by the bosses 46 and 48 within the fenestrations 50 and 52, the core 30 of the Bowden cable 24 will be reciprocated within the casing 26 thereof. The interior of the hand grip 32 may be provided with annular ribs 75 riding on the exterior of the tube 18.

The locking ring 38 is of generally cylindrical configuration having a full diameter forward portion 78 of substantially the same diameter as the diameter of the clam-shell halves 34 and 36 and a reduced diameter portion 80 at the rearward end portion thereof adapted to be fit within a generally cylindrical counterbore 82 defined within the forward end portion of the clam-shell halves 34 and 36. The reduced diameter portion 80 is provided with a pair of diametrically opposed generally arcuate radially inwardly extending grooves 84 and 86 separated by web segments 85. A pair of generally radially inwardly extending generally arcuate rib segments 88 and 90 integrally molded with the clam-shell halves 34 and 36, respectively, extend into the grooves 84 and 86. The angular extent or length of the ribs 88 and 90 are less than the angular extent or length of the grooves 84 and 86 while the longitudinal lengths are substantially coextensive so that, when assembled, the locking ring 38 may be rotated relative the clam-shell halves 34 and 36 to some angular extent which may, for example, be approximately 37.5°.

At the rearward end portion of the reduced diameter portion 80, the interior of the locking ring or collar 38 is provided with at least one, and preferably a pair of diametrically opposed generally outwardly extending arcuate counterbore segments 92 and 94 into which the generally arcuate detent springs 40 are positioned. The detent springs 40 comprise generally centrally disposed reversely arcuated detent portions 96 which are adapted to cooperate with mating pierced recesses 98 and 102, angularly located on centerlines spaced apart approximately 37.5°. The pierced recesses 98, which are diametrically opposed from one another are defined longitudinally by sheared edges 104 and 106 spaced longitudinally of the handle tube 18 a distance substantially complimentary to the width of the detent springs 40 and, particularly, of the reversely arcuated detent portions 96 thereof so that, when the detent portions 96 are engaged within the recesses 98, the hand grip control 32 is effectively latched against longitudinal sliding motion on the handle tube 18 whereby the transmission of the cleaner 10 remains in neutral for manual manipulation of the cleaner 10 by an operator. Upon rotation of the locking ring or collar 38 relative the hand grip control clam-shell halves 34 and 36 and the handle tube 18, so that the detent portions 96 of the detent springs 40 are engaged within the recesses 102, which are elongated relative the handle tube 18, as shown, the control or hand grip 32 is unlatched and is free to slide when pushed or pulled by an operator from its neutral position to the forward and reverse positions thereof whereat the transmission in the cleaner chassis 22 is engaged, respectively, in its forward and reversed configurations to automatically propel the cleaner 10 forwardly or reversely. An indicator lever 108 may be integrally formed extending generally radially outwardly of the locking ring or collar 38 to aid in operator rotation thereof and to indicate, in cooperation with mating indicia provided on the hand grip clam-shell half 34 whether the hand grip control is latched for manual movement of the cleaner or unlatched, for automatic, self-propelled movement thereof.

While the invention has been described, disclosed, illustrated and shown in terms of a preferred embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and spirit of the claims hereto appended.

I claim:

1. In an ansate self-propelled appliance having a drive motor and a reversible transmission mounted on a chassis for driving at least one chassis mounted wheel, a control or hand grip mounted on the handle comprising a pair of clam-shell halves having at least one inwardly extending boss, a guide perforation on the handle into which said boss extends providing limited sliding movement of said handle forward and aft and a locking collar structurally associated with at least one of said hand grip halves so as to be rotatable relative thereto while restrained against movement longitudinal relative thereof, said locking ring carrying at least one inwardly extending spring detent to selectively cooperate with a pair of angularly spaced apart recesses provided on said handle tube angularly offset one from the other, one of said recesses being of a length substantially coextensive with said detent spring so that when said detent spring is engaged therein, said hand grip is latched thereby against longitudinal sliding movement, the other of said recesses being elongated so that when said detent spring is engaged therewith, said hand grip control is slidable along the handle tube when pushed or pulled by an operator, and means for connecting said hand grip control with the transmission so that when said hand grip control is pushed forwardly by an operator said appliance will be self-propelled forwardly and when said hand grip control is pulled rearwardly by an operator said appliance will be self-propelled in a rearward direction.

2. Hand grip control defined in claim 1 wherein said detent spring is of generally arcuate configuration comprising a generally central reversely arcuate detent portion.

* * * * *